United States Patent [19]

Ueno et al.

[11] 4,252,177

[45] Feb. 24, 1981

[54] APPARATUS FOR LOADING CYLINDRICAL INSERTS

[75] Inventors: Toyoaki Ueno, Yamaguchi; Tatsuo Ishikawa, Ube, both of Japan

[73] Assignee: Ube Industries, Inc., Ube, Japan

[21] Appl. No.: 39,783

[22] Filed: May 17, 1979

[30] Foreign Application Priority Data

Jul. 10, 1978 [JP] Japan ..... 53-84372

[51] Int. Cl.[3] ..... B22D 17/24

[52] U.S. Cl. ..... 164/303; 164/333; 414/680

[58] Field of Search ..... 164/112, 303, 332, 333; 414/589, 680; 425/126 R

[56] References Cited

U.S. PATENT DOCUMENTS

| | | | |
|---|---|---|---|
| 3,160,290 | 12/1964 | Wilson | 414/680 |
| 3,703,968 | 11/1972 | Uhrich et al. | 414/680 |
| 4,178,984 | 12/1972 | Ishikawa | 164/333 |

*Primary Examiner*—Robert D. Baldwin

*Attorney, Agent, or Firm*—Blakely, Sokoloff, Taylor & Zafman

[57] ABSTRACT

In cylindrical insert loading apparatus of the type wherein an insert transfer unit is reciprocated by a transfer device between stationary and movable metal molds of a die cast machine and an insert supply unit, the insert transfer unit comprises a movable frame and insert loading cylinders are mounted on the movable frame with their operating axes cross with each other. After the inserts have been supplied from an insert supply furnace to the operating ends of insert loading cylinders, the insert transfer unit is moved between the stationary and movable molds while maintaining horizontal attitude. The movable frame is moved in the axial direction of the die cast machine until the insert transfer unit collides against the movable metal mold to align the inserts with the insert receiving sections in the movable metal mold. Thereafter, insert loading cylinders are operated to load the inserts and the insert transfer unit is returned to the insert supply furnace.

5 Claims, 9 Drawing Figures

APPARATUS FOR LOADING CYLINDRICAL INSERTS

BACKGROUND OF THE INVENTION

This invention relates to apparatus for loading cylindrical inserts in a metal mold of a die cast machine and which is especially suitable for use in a die cast machine designed to manufacture cylinder blocks of V-type internal combustion engines.

Where the cylinder block of an engine of a motor car and the like is manufactured by die casting molten aluminum, cylindrical inserts made of cast iron and later acting as cylinder liners are loaded in the metal mold of a die cast machine, and then molten aluminum is cast such that the cylindrical inserts and cast aluminum become integral. To accomplish this, it is necessary to use an insert loading apparatus capable of accurately supplying the cylindrical inserts to predetermined positions of the metal mold.

Such cylindrical insert loading apparatus must satisfy the following requirements. More particularly, it is required than an insert transfer unit which is reciprocated between an insert supply furnace and the metal mold of the die cast machine should be operated rapidly and smoothly, that the insert transfer unit should be correctly positioned at insert receiving positions of the metal mold, and that a plurality of inserts can be loaded simultaneously. To this end, the pitch between adjoining insert receiving positions should be equal to that to adjoining insert holders of the insert transfer unit.

In a cylinder block of an engine in which cylinders are arranged on a straight line or in a horizontally opposing configuration, it is only necessary to match the pitches in a plane perpendicular to the axis of the die cast machine, but in a case where the directions of loading the cylinder liners cross with each other as in the cylinder block of a V-type engine, in addition to the pitch matching described above, it is also necessary to correctly position the insert transfer unit with respect to the insert receiving positions in the axial direction of the die cast machine. However, since the separation of the movable metal mold from the stationary metal mold is determined by the operating timing of a limit switch, the movable metal mold stops with an error of 2 to 3 mm and the positioning in the axial direction becomes extremely difficult. Accordingly, it has been strongly desired to have improved insert loading apparatus capable of overcoming such difficulties.

SUMMARY OF THE INVENTION

Accordingly, it is the principal object of this invention to provide a novel cylindrical insert loading apparatus especially suitable for use in a die cast machine designed to manufacture V-type engines.

According to this invention, there is provided cylindrical insert loading apparatus of the type wherein an insert transfer unit is reciprocated by a transfer device between a stationary-movable metal mold interspace of a die cast machine and an insert supply unit, characterized in that the insert transfer unit comprises a movable frame reciprocatable in the axial direction of the die cast machine, a cylinder for moving the movable frame, a plurality of insert loading cylinders disposed on both sides of the movable frame, each insert loading cylinder including an inner rod having at one end a holder for holding an insert and an outer rod having a pushing sleeve for loading the insert into the movable mold, the plurality of insert loading cylinders being disposed such that their operation axes cross with each other, and a member mounted on the movable frame and which is adapted to engage the movable metal mold to be loaded with the inserts for aligning insert receiving sections in the movable metal mold with the insert loading cylinders.

BRIEF DESCRIPTION OF THE DRAWINGS

Further objects and advantages of the invention can be more fully understood from the following detailed description taken in conjunction with the accompanying drawings in which.

DESCRIPTION OF THE PREFERRED EMBODIMENTS

Figure 1:
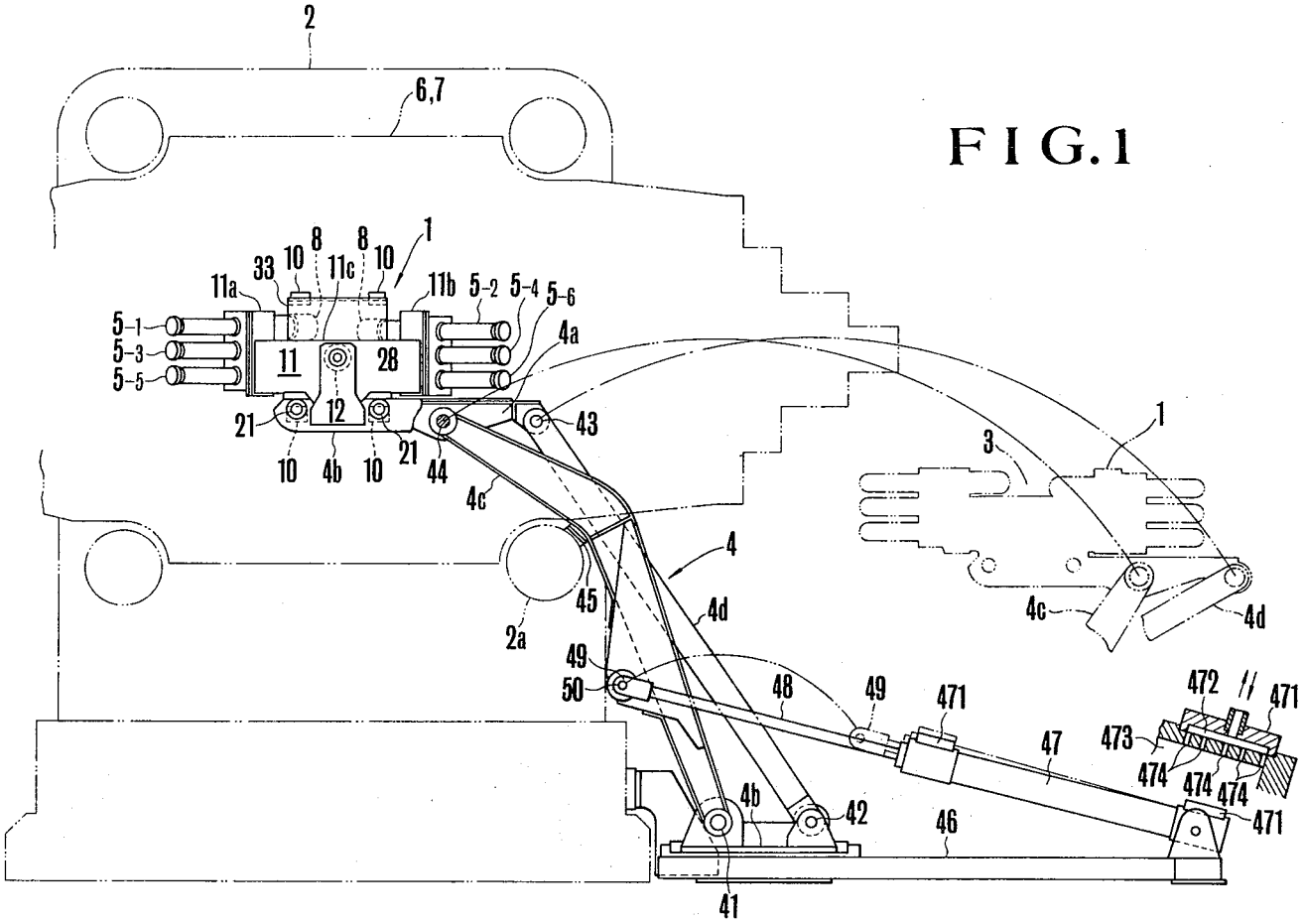
FIG. 1 is a front view showing one embodiment of the cylindrical insert loading apparatus constructed according to the teaching of this invention.

The preferred embodiment of this invention shown in FIGS. 1 through 4 comprises an insert transfer unit 1 which is reciprocated between a die cast machine 2 and an insert supply unit 3. In the embodiment illustrated, the insert transfer unit 1 provided with six insert loading cylinders 5-1 through 5-6 is reciprocated by a transfer device 4 made up of a parallelogram link mechanism between an interspace, defined by a stationary metal mold 6 and a movable metal mold 7, and a position shown by phantom lines in FIG. 1 for loading inserts 8 received from the insert supply unit 3 shown as an insert supply furnace 41 (see FIG. 4) into insert receiving sections 9 in the movable metal mold 7.

The insert transfer unit 1 comprises a movable frame 11 slidably (in a direction perpendicular to the sheet of FIG. 1) mounted on the transfer device 4, that is, on an extension **4*b* of a horizontally movable member 4*a* corresponding to the connecting rod of parallelogram link mechanism, a cylinder 12 for reciprocating the movable frame 11 in the axial direction (perpendicular to the sheet of FIG. 1) of the die cast machine 2, six insert loading cylinders 5-1 through 5-6 horizontally mounted on the side plates of the movable frame 11 with the operating ends of the cylinders on the inner side, and engagement members 10** for determining the position.

The construction of the insert loading cylinder 5 will be described with reference to FIG. 3A. As shown, the insert loading cylinder 5 comprises a cylindrical tube 51, a head end cover 52, a rod end cover 53, a cartridge 54, fluid passages 55 and 56, and inner and outer rods 57 and 58 slidable in the cylindrical tube 51. A cylindrical holder 59 fitted in an insert 8 (shown by dot and dash lines) for supporting the same is secured to the operating end of the inner rod 57, whereas a cylindrical push out cylinder 60 for pushing the insert 8 held by the holder 59 is mounted on the operating end of the outer rod 58. A flange 63 and stepped opening 64 which interfit in the direction of operation of the inner rod 57 are provided for the pistons 61 and 62 respectively of the inner and outer rods. A tapered projection 65 is provided at the center of the free end of the holder 59 to engage a positioning recess 13 provided for the movable mold, and a ball 67 biased outwardly by a compression spring 66 is contained at one side of the holder 59. The purpose of the ball 67 is to removably hold the insert 8 on the holder 59 by being pressed against the inner surface of the insert. Interconnecting bars 68 are secured to the inner end of the push out cylinder 60 for simultaneously actuating cylinders 5-1, 5-3 and 5-5 and cylinders 5-2, 5-4 and 5-6 which are arranged vertically. If several inserts are advanced randomly, there is a fear that some of them may not enter into the metal mold 7. But, the interconnecting bars 68 assure simultaneous advancement of a plurality of inserts. The cylinder 5 is secured to the movable frame 11 by a bracket 69 and provided with reinforcing ribs 71. Reference numeral 70 represents a threaded lid.

Figures 2A, 2B:
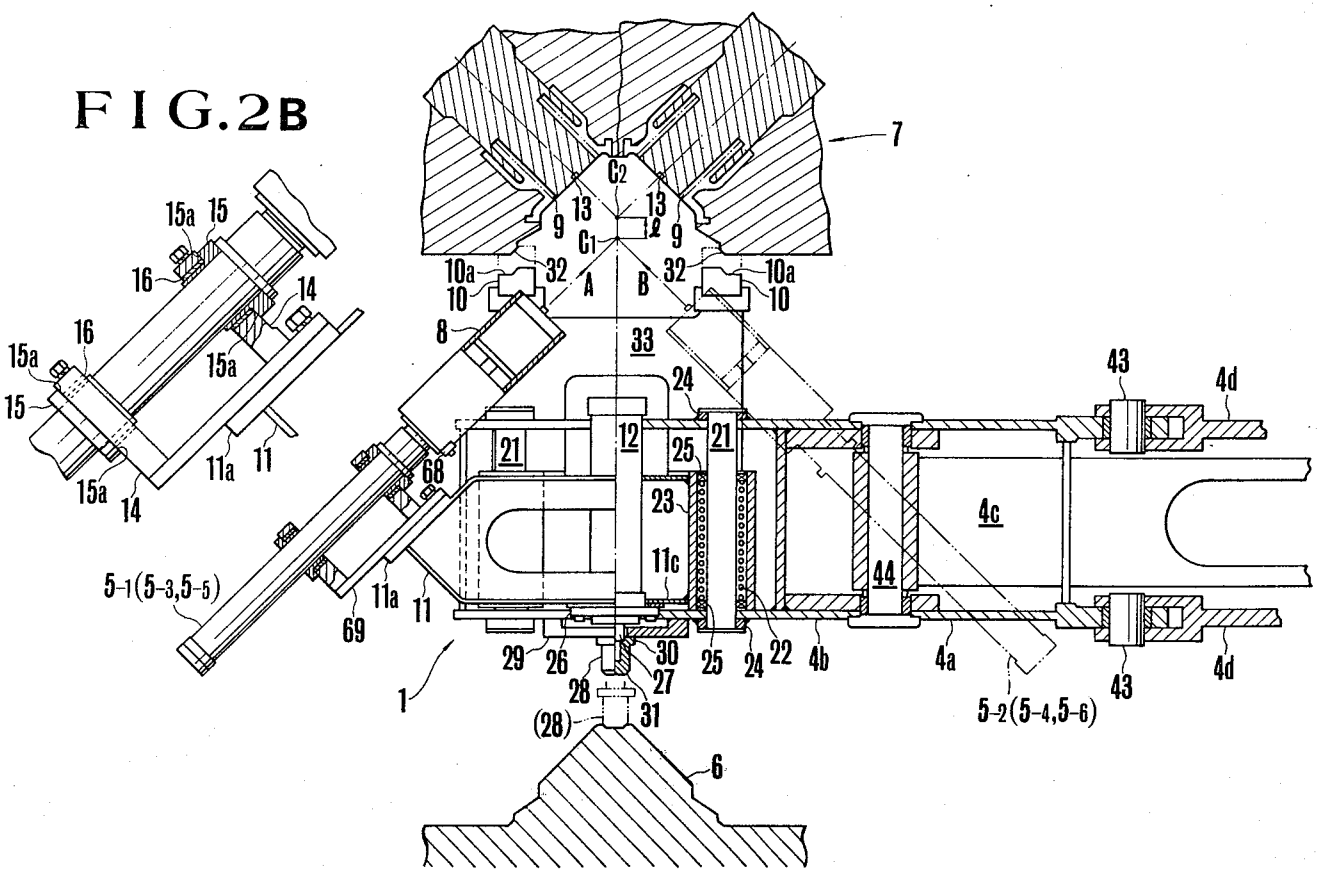
FIG. 2A is a plan view showing, in section, the insert transfer unit and the metal mold.
FIG. 2B is an enlarged side view of a cylinder support.
Figure 3A:
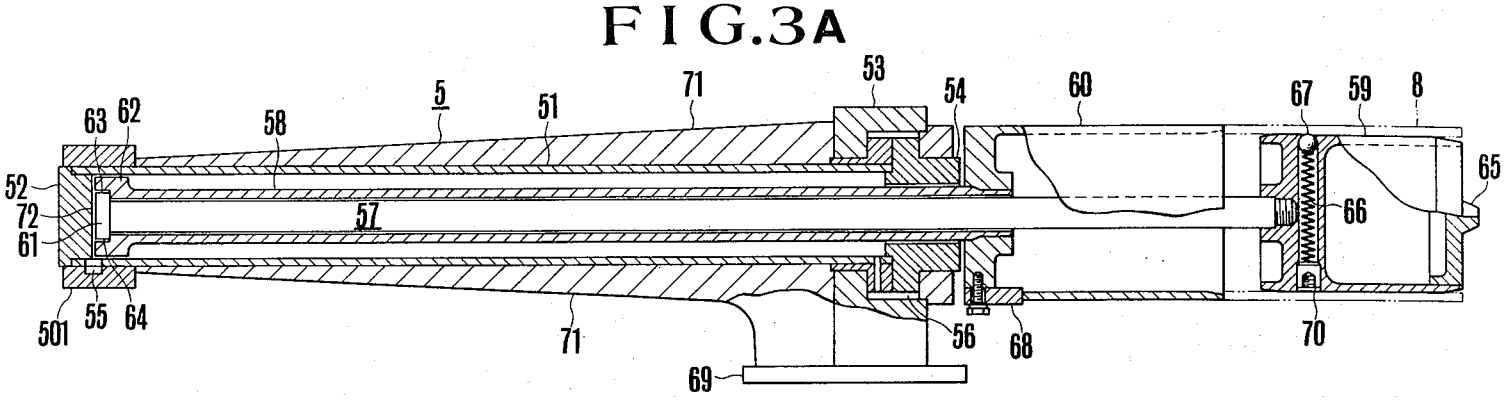
FIG. 3A is a longitudinal sectional view showing an insert loading cylinder.
Figure 5:
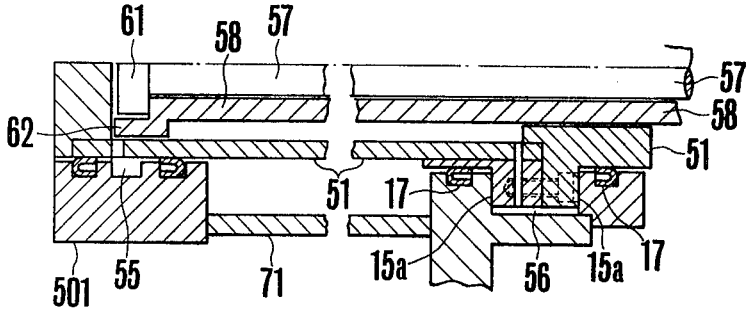
FIG. 5 is a sectional view showing a modified supporting structure of the insert loading cylinder.

In FIG. 3A, for the purpose of explaining the internal construction of the cylinder 5, a supporting structure for the movable frame 11 is not shown. Actually, however, as shown in FIG. 2B and FIG. 5, the cylinder 5 is mounted on the movable frame 11 such that it can tilt a little. More particularly, as shown in FIG. 2B, for holding the cylinder 5 at right angles on supporting members 14 connected with the movable frame 11, the cylinder 5 is mounted, in a semi-floating manner, on two supporting members 14 by way of two flanged bushings 15 and cylindrical cushion members 16 made of elastic material such as rubber having a thickness of 10 mm. The same object can be accomplished by using packings 17 having a Z or U-shaped crosssection as shown in FIG. 5.

In one example of the supporting structure shown in FIG. 2B, wherein the cylinder 5 is supported in semi-floating state so as to be movable a little in the horizontal direction, the distance between the vertical surfaces 15*a* of two flanged bushings 15 is relatively large so that it is difficult to maintain the cylinder 5 at right angles with respect to the supporting members 14. This difficulty can be eliminated by the construction shown in FIG. 5 in which the distance between two vertical surfaces 15*a* can be reduced.

With this construction, as shown in FIGS. 1 and 2A, the insert loading cylinders 5 are mounted on the movable frame 11 such that their axes, that is, the directions of loading the inserts shown by arrows A and B in FIG. 2A cross with each other in front of the movable metal mold 7. More particularly, cylinders 5-1, 5-3 and 5-5 are mounted on a support 11*a* on the lefthand side of the movable frame 11, whereas cylinders 5-2, 5-4 and 5-6 are mounted on the righthand support 11*b* with their operating ends directed inwardly. When viewed from FIG. 1 front view, the righthand and lefthand cylinders are asymmetrically arranged but as viewed from FIG. 2 plan view, they appear symmetrically. In other words, they are staggered in the vertical direction. A point C1 at which the axes of lefthand and righthand cylinders cross with each other on the plan view, is set at a position ahead a point C2 by a distance l where the axes of the insert receiving sections 9 cross with each other. The distance l varies somewhat due to the difference in the stop position each time the movable metal mold 7 is clamped.

As described above, the movable frame 11 is mounted on the extension 4*b* of the horizontally movable member 4*a*, and the detailed construction thereof will be described hereunder with reference to FIG. 2A. As shown, parallel guide shafts 21 extend across the extension 4*b* for supporting the movable frame 11 so as to be slidable in the vertical direction as viewed in FIG. 2A through bearings 22. Bearing cylinders 23 are secured to the movable frame 11 and the guide shafts 21 are secured to the extension 4*b* through bushings 24. Oil seals 25 are provided on the opposite ends of the bearings 24. For the purpose of reciprocating the movable frame 11, the cylinder 12 is provided to oppose the stationary metal mold 6. The cylinder 12 is secured to the rear plate 11*c* of the movable frame 11 by a flange 26 and an engagement member 28 is secured to the operating end of a piston rod 27. The engagement member 28 is provided with a flange 30 adapted to engage a stop 29 secured to the extension 4*b*. The tip of the engagement member 28 is tapered as at 31 to engage a recess in the stationary metal mold 6. The other engagement members 10 are secured to the movable frame 11 through a frame 33, projecting toward the movable metal mold 7.

Although in FIG. 2A, two symmetrically disposed engagement members 10 are shown, upper and lower symmetrically disposed engagement members, not shown, are also provided, and cuttings 32 slave to engagement members 10 are provided at corners of the opening of the movable metal mold 7. These engagement members 10 and cuttings 32 not only control the movement of the movable frame 11 but also correct position misalignment in the vertical direction together with preventing tilting of the insert tranfser unit 1. In other words, these members function to correctly position the insert loading cylinders at predetermined positions in front of the movable metal mold 7.

Consequently, when the cylinder 12 is operated while various members are maintained in a state shown by solid lines, the piston rod 27 projects downwardly (actually rearwardly) and the tip of the engagement member 28 engages the top of the stationary metal mold 6 as shown by phantom lines, thus limiting the projection of the piston rod.

Accordingly, the fluid pressure supplied to the cylinder 12 moves the cylinder itself secured to the movable frame 11 and hence the movable frame 11 is moved upward toward the movable metal mold 7. As the movable frame 11 moves, the engagement members 10 engage the cuttings 32 at corners of the opening of the mold 7, thus stopping the movement of the frame 11. At this time, the abovementioned distance decreases to zero and surfaces 10*a* of the engagement members 10 abut on the cuttings 32 so that point C1 coincides with point C2. By the engagement of the engagement member 28 with the stationary metal mold 6 and the engagement of the engagement members 10 with the cuttings 32 of the movable metal mold 7, not only the position alignment can be assured but also the movable frame 11 is stopped at the desired loading position without any tilting.

With the various elements maintained in this state, the insert loading cylinders 5 are actuated to load the inserts into the insert receiving sections 9 in the metal mold 7. These operations will be described with reference to FIGS. 3B and 3C.

Figure 3B:
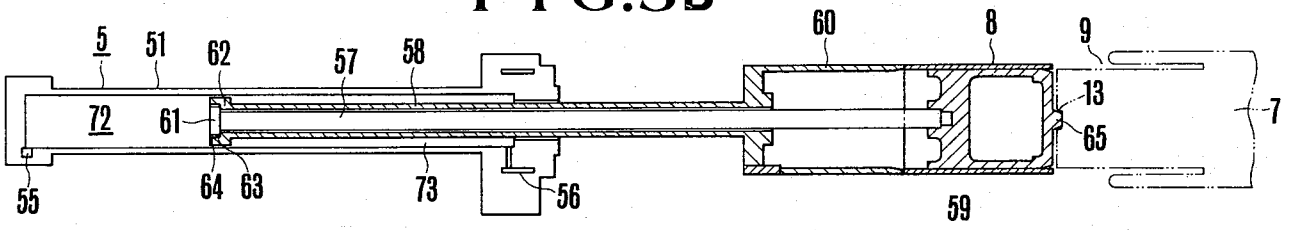
FIGS. 3B and 3C are simplified longitudinal sectional views useful to explain the operation of the insert loading cylinder.
Figure 3C:
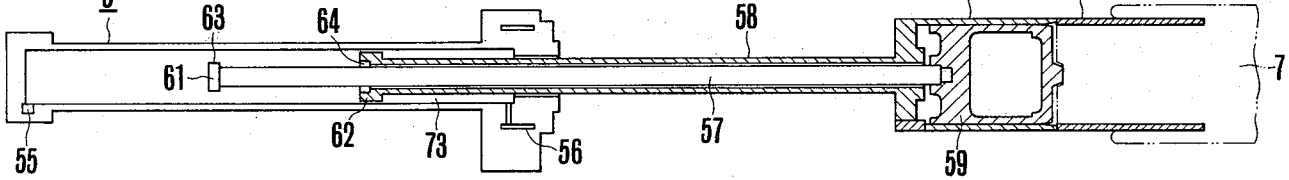

At first, fluid 11 is admitted into a pressure chamber 72 through a fluid passage 55 on the head end side, to push pistons 61 and 62, thus advancing the inner rod 57 and the outer rod 58, as shown in FIG. 3B. This advancement continues until the tip of the holder 59 engages the metal mold 7. This engagement occurs when the tapered projection 65 enters into the positioning recess 13 in the metal mold 7. This engagement, together with the cushion members 16 or 17 which support the cylinders 5, ensures correct positioning. More particularly, where the positions of the insert receiving sections 9 are more or less displaced due to the thermal expansion of the metal mold caused by temperature rise, the engagement of the projection 65 with the recess 13 causes parallel movements of the cylinders 5 against the resiliency of the cushion members 16, thus perfectly aligning the inserts with the insert receiving sections 9. In this manner, the holder 59 is stopped by engaging the movable metal mold 7. At this time, since the fluid pressure still acts upon the piston 62 of the outer rod 58, only the outer rod 58 advances as shown in FIG. 3C so as to press the insert 8 by the tip of the push out cylinder 60 at the operating end of the outer rod, thus loading the insert into the insert receiving section 9 in the metal mold 7. Upon completion of the loading, the fluid passage 55 is opened whereas the pressurized fluid is admitted into the pressure chamber 73 from a fluid passage 56. This fluid pressure first acts upon the piston 62 to restore the outer rod 58. As the outer rod 58 is returned to the position shown in FIG. 3B, the flange 63 of the inner rod 57 will fit into the stepped opening 64. Thereafter, the inner and outer rods are simultaneously moved to the original position.

Since the directions of operations of the left side cylinders 5-1, 5-3 and 5-5 and the right side cylinders 5-2, 5-4 and 5-6 intersect at an angle as described above, it is impossible to operate both the left and right side cylinders at the same time. Therefore, it is necessary to construct the operating circuit, not shown, for these insert loading cylinders such that after completion of the cylinders on one side, the cylinders on the other side are operated.

The insert transfer unit 1 which has loaded the inserts into the movable mold 7 is moved to one side of the die cast machine 2 by the transfer device 4 (as will be described later) to be supplied with new inserts which are to be loaded next time by the insert supply unit 3.

Figure 4:
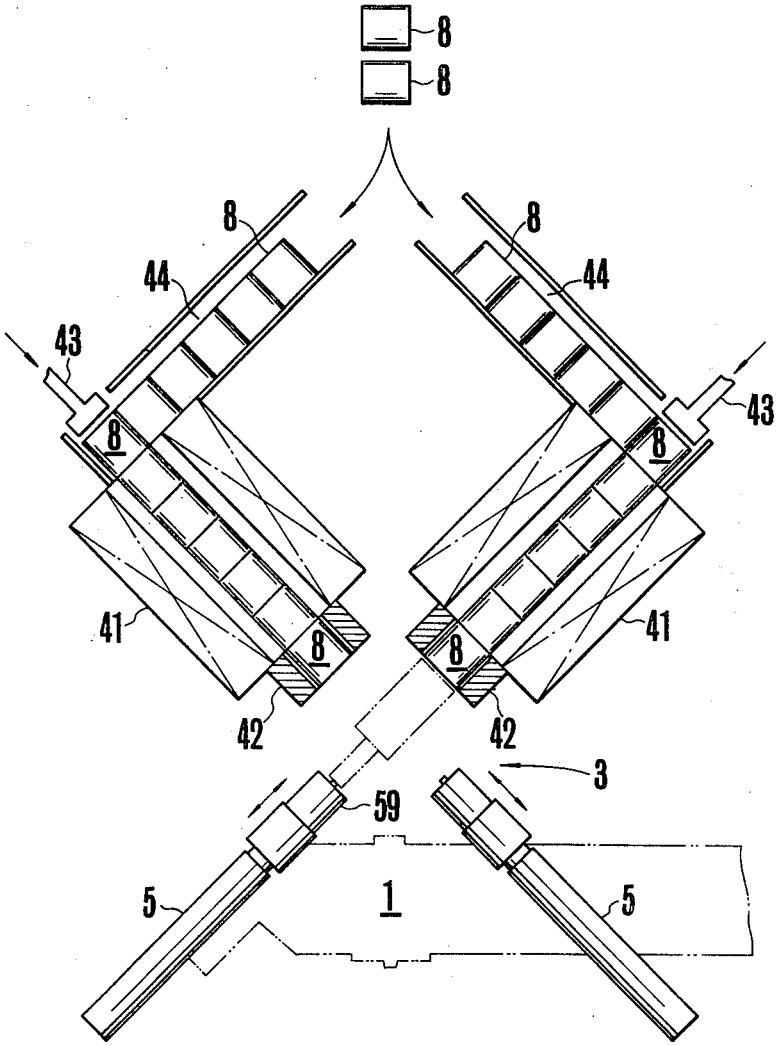
FIG. 4 is a plan view showing an insert supply unit.

FIG. 4 is a plan view showing one example of the insert supply unit 3. As shown, there is provided insert heating furnaces 41 provided with three vertically superposed shooters corresponding to the three vertically aligned insert loading cylinders 5-1, 5-3 and 5-5 and those 5-2, 5-4 and 5-6 and the directions of the supply of the inserts are made to correspond to the left and right side cylinders of the insert transfer unit 1. Guide members 42 are provided for the exit ports of the heating furnaces for holding the inserts at positions corresponding to the holders 59 of the cylinder 5. Each heating furnace 41 is provided with a pusher 43 at the inlet end and the inserts are conveyed to respective heating furnaces by conveyors 44. The guide members 42 act also as soaking zones for maintaining the inserts at a constant temperature so as to readily mount the inserts on the insert holders 59. The inner surfaces of the guide members 42 and the outer surfaces of the inserts are precisely machined so as to ensure definite spacings therebetween.

To operation, the cylinders 5 are operated to bring the holders to approach the guide members 42 as shown by phantom lines so as to receive the inserts pushed by the pushers 43 onto the holders 59. Since the operations of the cylinders at the supply unit are similar to those at the time of loading, the detailed description thereof is believed unnecessary. To make smooth the mounting and dismounting operations of the inserts, the fore and aft ends of the holders and the fore ends of the push out cylinders are bevelled.

The transfer device 4 which reciprocates the insert transfer unit 1 between the stationary-movable mold interspace and the insert supply unit 3 will now be described. The transfer device includes a parallelogram structure so that the insert transfer unit 1 can reciprocate while maintaining horizontal posture. As shown, the transfer device 4 is adapted to support the insert transfer unit 1 and comprises a horizontal member **4*a* corresponding to the connecting rod of a parallelogram structure, a stationary frame 4*b* corresponding to the stationary link, an operating arm 4*c*, a supporting arm 4*d* and pivot pins interconnecting these members, whereby the lines interconnecting the axes of these pivot pins form a parallelogram. The operating arm 4*c* is bent so as not to interfere with a tie bar 2*a* of the die casting machine and a stop member 45 adapted to engage the tie bar 2*a*** is provided at the bend.

The transfer device 4 is mounted on a base 46 and a clevis type cylinder 47 is also mounted on the base 46. The operating end 49 of the piston rod 48 is connected to the operating arm **4*c* through a pin 50. An oil supply and discharge member 471 of the cylinder 47 is formed with a plurality of small perforations 474 extending in a direction perpendicular to the axis of the cylinder for communicating an oil supply and discharge chamber 472 with a cylinder chamber 473. With this construction, since the perforations are closed and opened as the piston moves, the number of perforations communicating with the cylinder chamber 473** increases on the oil supply side when the piston advances, but the number of the perforations decreases on the discharge side, thus alleviating shock at the time of starting and stopping the operation.

Accordingly, when the cylinder 47 is operated while it is maintained in a position shown in FIG. 1, the operating arm **4*c* and the supporting arm 4*d* are rotated in the clockwise direction so that the insert transfer unit 1 supported by the horizontally movable member 4*a* is moved to one side of the die cast machine 2, that is, to a position shown by phantom lines 3. At this position, the inserts are supplied to the insert transfer unit 1 for preparing the next insert loading operation. During this time, the die cast machine 2 is operated to perform die casting. As the movable metal mold is retracted to a waiting position after completion of the die casting operation, the cylinder 47 is operated to perform the operations in the reverse order to bring the insert transfer unit 1** to the position shown by solid lines. The positioning at this time and the succeeding insert loading operation are the same as those described above.

Figure 6:
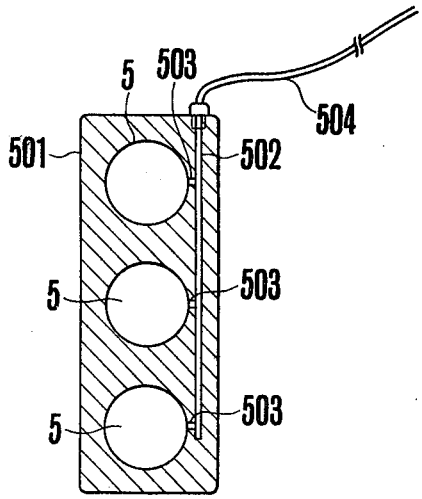
FIG. 6 is a longitudinal sectional view showing the cylinder connecting plate shown in FIG. 5.

FIG. 6 shows a connecting plate 501 utilized to supply and discharge operating fluid into and out of the insert loading cylinders 5. The purpose of the connecting plate 501 is to eliminate pipings for respective cylinders 5-1 through 5-6 and to form oil passages to the head end covers 52 of the left and right side cylinders 5-1, 5-3, 5-4 and 5-2, 5-4 and 5-6 and to respective rod end covers 53. Thus, the discharge ports of three juxtaposed cylinders are connected together by the connecting plate 501 through a passage 502 connected to a flexible pipe 504 and through a branch passage 503. According to the conventional construction, respective cylinders are connected to three independent flexible pipes whereas according to this construction, only one flexible tube is sufficient. Accordingly, it is possible to minimize the bending of the flexible pipe at the time of starting the operations and hence to minimize the vibration of the cylinders.

As described above, according to this invention, since the insert transfer unit is constructed by a movable frame movable in the direction of the axis of the die cast machine regardless of a slight error in the stop position of the movable metal mold, it is possible to correctly align the axes of the inserts with the axes of the insert receiving sections. Cooperation of the engagement members of the movable frame with the slave cuttings of the metal mold assures correct position alignment not only in the horizontal direction but also in the vertical direction. Furthermore, by the engagement of the piston rod of the cylinder for moving the movable cylinder with the opposing metal mold, it is possible to accurately hold the insert transfer unit at a predetermined position. Accordingly, it is possible to accurately position the insert transfer unit mounted on the end of a long arm which tends to vibrate with reference to the metal mold, thus preventing the transfer unit from vibrating during loading of the inserts. This makes it possible to automatically and readily load the inserts into the metal mold in a high temperature atmosphere.

Since the insert loading cylinder is provided with concentric inner and outer rods operated by fluid pressure, different from the prior art construction in which the piston of the inner rod is contained in the outer rod and a spring is contained in the outer rod on the rear side of the piston of the inner rod, the construction of the insert loading cylinder is simplified and various cylinders can be operated uniformly irrespective of the difference in the characteristics of the springs.

Moreover, since the insert transfer unit is reciprocated between the die cast machine and the insert supply unit by a transfer device constituted by a paralleogram link mechanism, the inserts carried by the insert transfer unit are moved always in the horizontal stage, so that there is no fear of dropping.

As the insert loading cylinder is semi-floatingly supported by the movable frame, even when the loading position is varied due to the thermal expansion of the metal mold, the insert loading cylinder can follow such shifting, thus assuring accurate loading of the inserts.

When the die cast machine is constructed such that an operating arm engages the tie bar thereof as shown in the drawing, the operating arm is controlled at a position near the mold, so that the stop position thereof can be made more accurate. Where multi-opening type oil supply and discharge member as described above is provided for the cylinder which operates the operating cylinder, the shock can be more positively alleviated than a case where an independent shock absorber is used.

What is claimed is:

1. In cylindrical insert loading apparatus of the type wherein an insert transfer unit is reciprocated by a transfer device between a stationary-movable metal mold interspace of a die cast machine and an insert supply unit, the improvement wherein said insert transfer unit comprises a movable frame reciprocatable in the axial direction of said die cast machine, a cylinder for moving said movable frame, a plurality of insert loading cylinders disposed on both sides of said movable frame, each insert loading cylinder including an inner rod having at one end a holder for holding an insert, and an outer rod having a pushing sleeve for loading said insert into the movable mold, said plurality of insert loading cylinders being disposed such that their operation axes cross with each other, and a member mounted on said movable frame and which is adapted to engage said movable metal mold to be loaded with said inserts for aligning insert receiving sections in said movable metal mold with said insert loading cylinders.

2. A cylindrical insert loading apparatus according to claim 1 wherein said transfer device comprises a parallelogram link mechanism which reciprocates said insert transfer unit in the horizontal state.

3. A cylindrical insert loading apparatus according to claim 1 which further comprises a cylinder for operating said movable frame such that said member is urged against a cutting of said movable metal mold and that a rod is urged against said stationary metal mold.

4. A cylindrical insert loading apparatus according to claim 1 wherein each one of said insert loading cylinders is mounted on said movable frame by means of an elastic member.

5. A cylindrical insert loading apparatus according to claim 1 wherein said plurality of insert loading cylinders are juxtaposed, and the pushing sleeves of respective cylinders are interconnected by a connecting bar.

* * * * *